US006015321A

United States Patent [19]

Ozawa et al.

[11] Patent Number: 6,015,321

[45] Date of Patent: Jan. 18, 2000

[54] FUEL PUMP MOUNTING ARRANGEMENT FOR PERSONAL WATERCRAFT

[75] Inventors: Sigeyuki Ozawa; Ryoichi Nakase, both of Iwata, Japan

[73] Assignee: Yamaha Hatsudoki Kabushiki Kaisha, Iwata, Japan

[21] Appl. No.: 08/998,643

[22] Filed: Dec. 29, 1997

[30] Foreign Application Priority Data

Dec. 28, 1996 [JP] Japan ..... 8-359049

[51] Int. Cl.[7] ..... B63H 21/32

[52] U.S. Cl. ..... 440/88; 114/55.5; 123/509

[58] Field of Search ..... 114/55.5; 440/88; 123/509

[56] References Cited

U.S. PATENT DOCUMENTS 4,722,708 2/1988 Baltz ..... 440/88
4,773,883 9/1988 Nakase et al. ..... 114/55.5
5,537,948 7/1996 Kobayashi et al. ..... 440/88
5,788,547 8/1998 Ozawa et al. ..... 440/88

*Primary Examiner*—Jesus D. Sotelo
*Attorney, Agent, or Firm*—Knobbe, Martens, Olson & Bear LLP

[57] ABSTRACT

A fuel pump mounting arrangement for a fuel system of an engine powering a watercraft is disclosed. The watercraft has a hull defining an engine compartment and having a lower surface, a water propulsion device, and an internal combustion engine positioned in the engine compartment and supported by the lower surface of the hull. The engine has an output shaft arranged to drive the water propulsion device. The watercraft has an air intake system for supplying the engine with air for use in a combustion process, the intake system including at least one air intake through the hull leading into the engine compartment, the watercraft including a fuel supply system for supplying fuel from a fuel supply to the engine for combustion, the fuel supply system including a fuel pump delivering fuel from the fuel supply to said engine, the fuel pump positioned to avoid exposure to water which enters the engine compartment through the hull.

10 Claims, 7 Drawing Sheets

FUEL PUMP MOUNTING ARRANGEMENT FOR PERSONAL WATERCRAFT

FIELD OF THE INVENTION

The present invention relates to a fuel system of an engine powering a watercraft. More particularly, the present invention relates to a mounting arrangement for a fuel pump of such a fuel system.

BACKGROUND OF THE INVENTION

Personal watercraft have a hull which defines an engine compartment. The personal watercraft is propelled by a water propulsion device, such as an impeller which propels water at high velocity out a propulsion passage directed towards a rear of the watercraft.

The water propulsion device is powered by an engine which is positioned within the engine compartment. When the engine is of the internal combustion type, a fuel system is arranged to provide fuel to one or more combustion chambers of the engine. The fuel system usually includes a fuel tank positioned within the hull of the watercraft, and a fuel pump which delivers fuel from the tank to one or more charge formers for introducing the fuel into the engine.

Air is also delivered to the engine for use in the fuel combustion process. The engine has an intake arranged to draw air from within the engine compartment defined by the hull. Air is drawn into the engine compartment through one or more air intake passages through the hull. Typically, the intake passages are defined by intake pipes leading from the hull downwardly to a terminus within the engine compartment.

One problem with these watercraft is that the fuel pump is susceptible to corrosion and damage when exposed to water. The water may flow into the engine compartment through the intake passages through the hull. In addition, once water enters the hull, it may fill the bottom of the hull and splash about. Premature failure of the fuel pump is costly to the operator, and may strand the operator of the craft.

A watercraft having a fuel pump arranged to overcome the above-stated problems, is desired.

SUMMARY OF THE INVENTION

In accordance with the present invention there is provided a fuel pump mounting arrangement for a fuel pump of a fuel system of an engine powering a watercraft.

The watercraft has a hull defining an engine compartment and having a lower surface, a water propulsion device, and an internal combustion engine positioned in the engine compartment and supported by the lower surface of the hull. The engine has an output shaft arranged to drive the water propulsion device.

The watercraft has an air intake system for supplying the engine with air for use in a combustion process, the intake system including at least one air intake through the hull leading into the engine compartment. The watercraft also includes a fuel supply system for supplying fuel from a fuel supply to the engine for combustion. The fuel supply system includes a fuel pump delivering fuel from the fuel supply to the engine, the fuel pump positioned to avoid exposure to water which enters the engine compartment through the hull.

In one preferred embodiment of the invention, the fuel pump is positioned above the lower surface of the hull higher than the at least one air intake.

In accordance with a preferred embodiment of the invention, the watercraft includes a bilge pump having an inlet positioned near the lower surface of the hull. The fuel pump is positioned above the inlet of the bilge pump.

The fuel pump as arranged in accordance with the present invention has the advantage that it is positioned to avoid water which enters the engine compartment of the watercraft through the hull and which collects at the lower surface of the hull.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
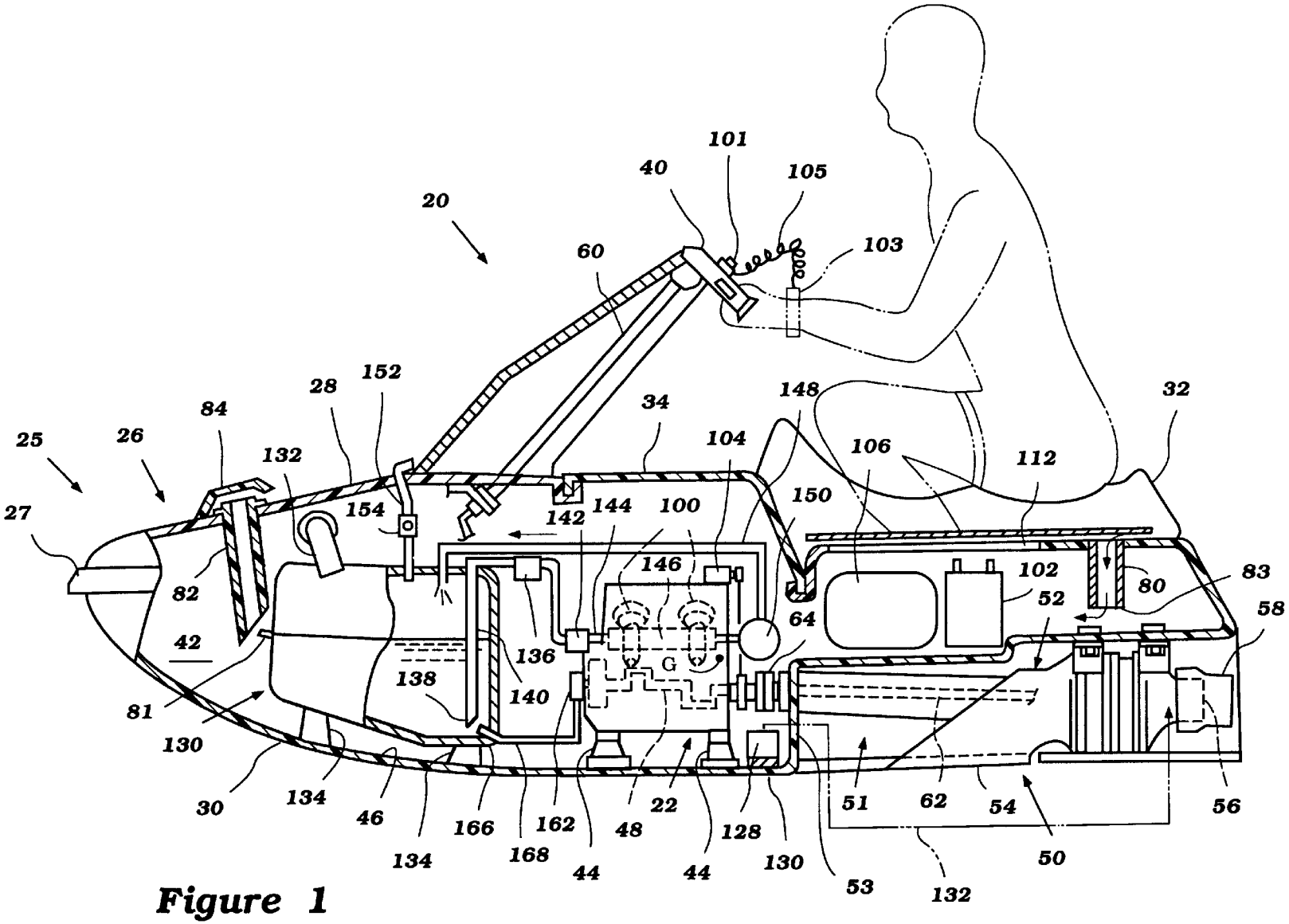
FIG. 1 is a cross-sectional side view of a watercraft powered by an engine and having a fuel supply system including a fuel pump, the fuel pump mounted in accordance with a first embodiment of the present invention.

FIGS. 1–5 illustrate a watercraft 20 in accordance with a first embodiment of the present invention, the watercraft 20 having a fuel pump mounted in accordance with the invention. As illustrated, the watercraft 20 generally comprises a watercraft body 25 having the engine 22 mounted therein for powering a water propulsion device. The watercraft body 25 preferably comprises a hull 26 having a top portion or deck 28 and a lower portion 30. A gunnel 27 defines the intersection of the hull 26 and the deck 28.

In addition, the body 25 includes a seat 32 positioned on the top portion 28 of the hull 26. A removable deck member 34 forms a part of the top portion 28 of the hull 26, the deck removable to provide access to the engine 22 positioned therebelow. A steering handle 40 is provided adjacent the seat 32 for use by a user in directing the watercraft 20 in a manner described in more detail below.

The top and bottom portions 28,30 of the hull 26 cooperate to define an engine compartment 42. The engine 22 is positioned in the engine compartment 42. The engine 22 is connected to the hull 26 via several engine mounts 44 connected to a bottom 46 of the lower portion 30 of the hull 26. As described above, the engine 22 is preferably partially accessible through a maintenance opening which is formed by removal of the removable deck member 34.

The engine 22 has a crankshaft 48 arranged to drive a water propulsion device 50 of the watercraft 20. The water propulsion device 50 preferably comprises a propulsion passage 52 in which is positioned an impeller (not shown). The propulsion device 50 is preferably positioned in a propulsion compartment 51 which is defined by the lower portion 30 of the hull 26, including a wall section 53 thereof.

The propulsion passage 52 has an inlet 54 positioned in the bottom of the hull 26, and an outlet 56 facing a stem of the craft 20. The impeller is positioned in the passage 52 between the inlet 54 and outlet 56 and is driven by an impeller shaft 62. The impeller shaft 62 extends from the impeller through the wall 53 of the lower portion 30 of the hull 26 into the engine compartment 42. The impeller shaft 62 is driven by the crankshaft 48 of the engine 22 through a coupling 64.

A nozzle 58 is movably positioned at the outlet 56 of the passage 52 for directing water which is forced through the outlet. The nozzle 58 is connected to the steering handle 40 through a steering linkage 60 (only part of which is shown). In this manner, the operator of the craft 20 may direct the craft in different directions by directing the propelled water with the nozzle 58 by turning the steering handle 40.

Figure 2:
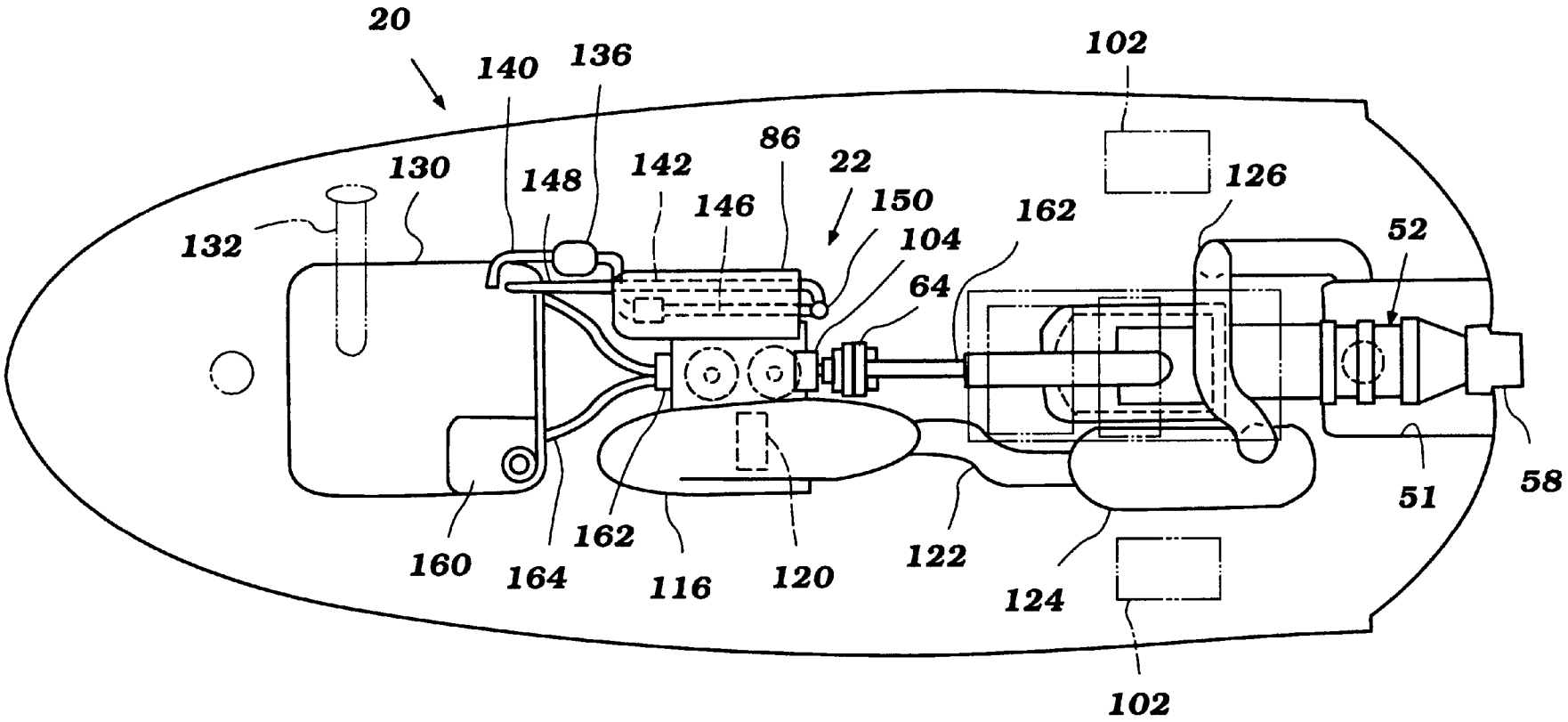
FIG. 2 is a top cross-sectional view of the watercraft illustrated in FIG. 1, exposing the engine and other internal features of the watercraft.
Figure 3:
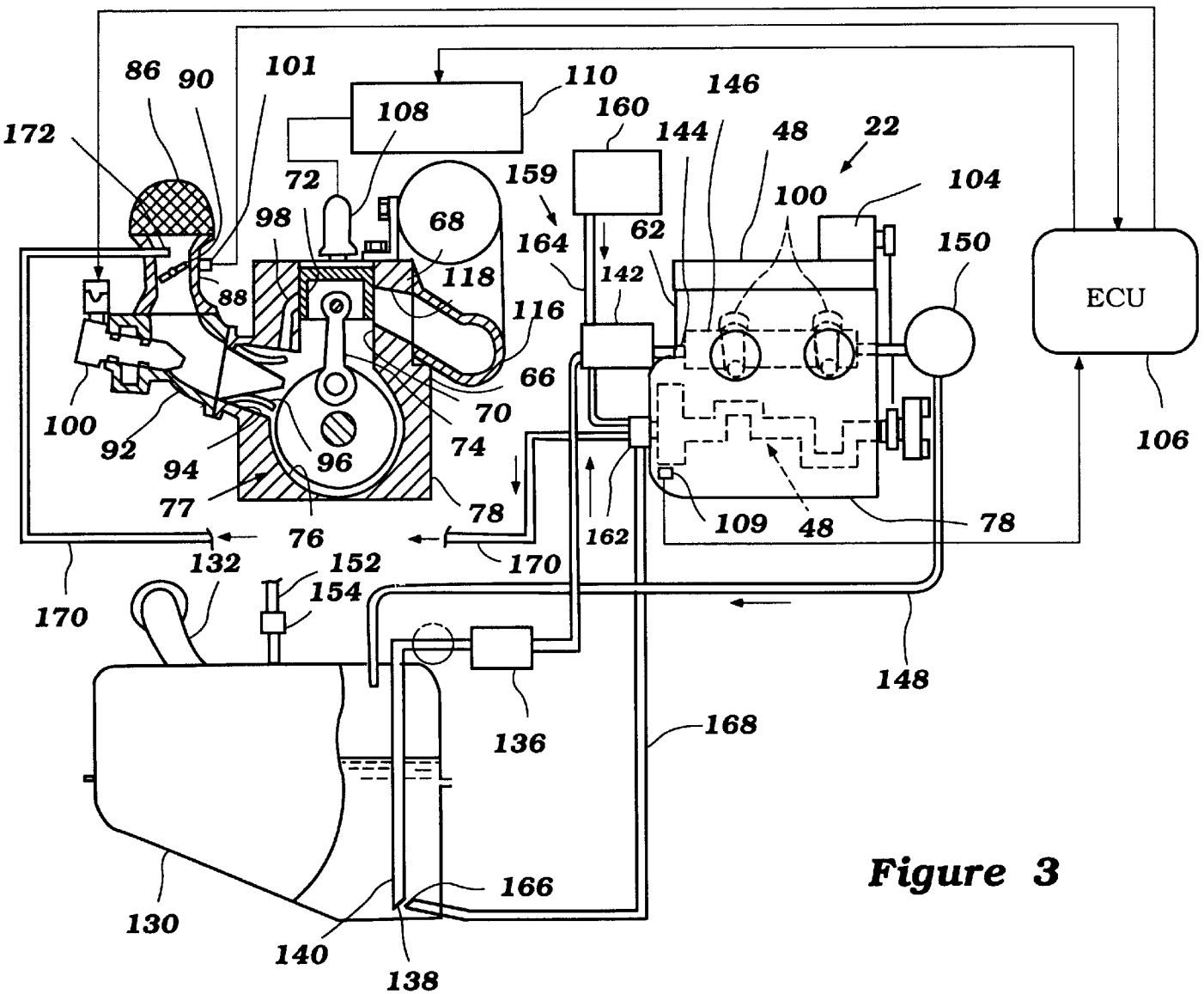
FIG. 3 is a schematic illustrating the engine and fuel supply system of the first embodiment of the present invention.

The engine 22 is best illustrated in FIGS. 1–3. As illustrated therein, the engine 22 is preferably of the two-cylinder variety, arranged in in-line fashion and operating on a two-cycle principle. Of course, the engine 22 may have as few as one, or more than two, cylinders, as may be appreciated by one skilled in the art.

The engine 22 includes a cylinder block 66 having a cylinder head 68 connected thereto and cooperating therewith to define two cylinders 70. A piston 72 is movably mounted in each cylinder 70 and connected to the crankshaft 62 via a connecting rod 74.

The crankshaft 62 is rotatably journalled with respect to the cylinder block 66 within a crankcase chamber 77. Preferably, the chamber 77 is defined by an inner surface 76 of a crankcase cover member 78 which extends from a bottom portion of the cylinder block 66.

The engine 22 includes means for providing an air and fuel mixture to each cylinder 70 for combustion therein. Referring to FIG. 1, air is drawn in to the engine compartment 42 through a pair of air inlets 80,82 in the hull 26. As illustrated, a front inlet 82 is extends through the top portion 38 of the hull 26 to an outlet 81 positioned some distance below the top portion 28 of the hull 26. To reduce the occurrence of water entering this inlet 82, a cover element 84 extends partially over the inlet 82. The other inlet 80 is positioned below the seat 32, with air drawn thereto through a space between the seat 32 and the top portion 28 of the hull 26. This inlet 80 has an outlet 83 which is also positioned some distance below the top portion 28 of the hull 26.

Air within the engine compartment 52 is drawn through a filtered intake 86 into a throttle body 88. As illustrated in FIG. 3, a throttle valve 90 is movably positioned in the throttle body 88 for controlling the rate of air flow therethrough. The throttle valve 90 is preferably actuated by the operator of the watercraft 20 by a throttle control positioned on the steering handle 40.

An intake manifold 92 extends between the throttle body 88 and the engine 22. The intake manifold 92 defines a passage therethrough corresponding to each cylinder. Each passage through the manifold 92 leads to a corresponding intake passage 94 through the engine 22 into the crankcase chamber 76. The crankcase chamber 76 is divided into compartments corresponding to each cylinder 70. A reed-type valve 96 is positioned in each intake passage 94. The reed valve 96 is arranged to permit the flow of air into the crankcase 76 but prevent the flow of air out of the crankcase 76 in the direction of the manifold 92.

As is well known in the two-cycle engine art, the engine is arranged so that when the piston 72 moves upwardly, air is drawn through the intake system, including the reed valve 96 into the crankcase chamber 76. As the piston 72 moves downwardly, the air is compressed and eventually flows through a scavenge passage 98 leading into the portion of the cylinder 70 above the piston 72.

Preferably, fuel is provided to each cylinder 72 for combustion with the air. The fuel system will be described in more detail below, but preferably includes a fuel injector 100 which injects fuel into the air passing through the passage through the manifold 92.

An ignition system is provided for igniting the fuel and air charge which is supplied to the cylinder 70. Preferably, this ignition system includes a power source, such as a pair of batteries 102 (see FIG. 1) and/or a generator 104. An electronic engine control unit (ECU) 106 is arranged to fire an ignition element 108 corresponding to each cylinder 70 through an ignition coil 110.

The batteries 102 are positioned in the hull 26 of the craft 20 in an area below the seat 32, as is the ECU 106. Preferably, the seat 32 is removably connected to the top portion 28 of the hull 26 and positioned over an access opening 112 therein, permitting access to the batteries 102 and ECU 106 positioned therebelow.

In the preferred embodiment, each ignition element 108 preferably comprises a spark plug. A crankshaft sensor 109 preferably provides timing data to the ECU 106 for use in controlling the timing of the ignition of the spark plugs 108.

The watercraft 20 preferably includes a lanyard switch 101 for controlling the ignition. As illustrated, the switch 101 is preferably mounted near the steering handle 40. The switch 101 includes a wrist band 103 which the operator of the watercraft 20 wears, and a cord 105 extending between the band 103 and the switch 101. The switch 101 is arranged so that in one position, the power is provided to the ignition circuit 110 and/or ECU 106, permitting the engine 22 to run, and in a second position when the cord 105 is pulled (such as when the operator of the craft 20 falls off) the switch prevents power from flowing to the ignition system and thus shuts off the engine 22.

Exhaust gas generated by the engine 22 is routed from the engine to a point external to the watercraft 20 by an exhaust system which includes an exhaust manifold 116. Exhaust from each cylinder 70 is preferably expelled therefrom to the exhaust manifold 116 through an exhaust passage 118 extending through the cylinder head 68. An exhaust timing valve may be provided in the passage 118 for controlling the timing of the opening and closing of the passage 118, as is well known to those of skill in the art.

As best illustrated in FIG. 2, the exhaust manifold 116 extends towards a front end of the engine 22, before looping back to an expanded portion which extends along a top of the engine towards the rear of the watercraft 20. A catalyst 120 is preferably positioned in this expanded portion of the manifold 116.

The manifold 116 leads to an upper exhaust pipe 122. This upper exhaust pipe 122 leads to a water lock 124, as well known in the art, and thereon to a lower exhaust pipe 126. The second portion of the exhaust pipe 126 terminates in the propulsion compartment 51, where the exhaust gases from the engine 22 are discharged.

Preferably, the watercraft 20 includes a bilge 128 positioned at the bottom 46 of the hull 26 within the engine compartment 42. The bilge 128 has a pump arranged to draw liquid through a screened inlet 131 and discharge the liquid through a discharge line 133 which extends to the propulsion compartment 51.

In an alternate arrangement, the discharge line 133 may extend from near the bottom surface 46 of the hull 26 directly into the propulsion passage 54. In that instance, the flow of fluid through the propulsion passage 54 serves to draw or pump fluid through the line 133 from the engine compartment 42, thus eliminating the need for a separate pump (128).

The fuel system will now be described in more detail in conjunction with FIGS. 1–3. As illustrated, the fuel system includes a fuel supply. Preferably, this supply comprises fuel within a tank 130. As illustrated, the tank 130 is positioned in the engine compartment 42, forward of the engine 22 towards the front of the craft 20. The tank 130 is preferably supported above the bottom surface 46 of the lower portion 30 of the hull 26 by several legs or supports 134.

A fill spout 132 extends from the tank through the upper portion 28 of the hull 26. A user of the craft 20 may fill the tank 130 with fuel through the spout 132.

Means are provided for delivering fuel from the tank 130 to the engine 22. Preferably, this means comprises a fuel pump 136. The pump 136 may be of a variety of types as known to those of skill in the art, but is preferably electrically powered. The pump 136 draws fuel from the tank 130 through an inlet 138 of a delivery line 140. Preferably, as illustrated in FIG. 3, the inlet 138 of the delivery line 140 is positioned near a bottom of the tank 130 in a portion of the tank 130 closest to the engine 22.

The pump 136 preferably delivers the fuel through a filter element 142 positioned along the line 140, and thereafter to a high pressure line 144 extending to a fuel rail 146. The fuel injectors 100 are connected to the fuel rail 146, whereby fuel at high pressure is delivered to the injectors 100.

Preferably, as also illustrated in FIG. 3, each injector 100 is of the electrically-actuated type. In this arrangement, the ECU 106 is arranged to control the timing of the injectors 100 turning on and off, and thus the timing of the injection of the fuel by each injector 100. Preferably, each injector 100 is controlled with an electrically powered solenoid, and at least the solenoid portion of each injector 100 is protected with a seal element to prevent corrosion by exposure to water and other elements.

A throttle position sensor 101 provides throttle valve 88 position data to the ECU 106. The ECU 106 preferably utilizes this information to control the duration of the fuel injection.

Fuel which is supplied to the injectors 100 through the fuel rail 146 but not delivered by the injectors 100 to the engine 22 is preferably routed back to the fuel tank 130. As illustrated, a return line 148 extends from an end of the fuel rail 146 opposite the end the high pressure delivery line 144 is connected to. This return line 148 extends to the fuel tank 130. Preferably, a control valve 150 is positioned along the return line 148. The valve 150 is arranged to maintain the pressure within the fuel rail 146 at a high pressure, and yet allow excess fuel to return to the tank 130.

A vapor relief line 152 preferably extends from the tank 130 through the upper portion 28 of the hull 26 for routing vapor from within the tank 130 to a point external to the watercraft 20. A roll-over valve 154 is positioned along the line 152 for preventing the fuel from flowing from the tank 130 through the line 152 in an instance where the watercraft 20 is rolled upside down.

The engine 22 includes an oil supply system 159 for providing lubricating oil to the engine. The oil supply system preferably includes lubricant or oil supply. In the embodiment illustrated in FIGS. 1–3, the oil supply preferably comprises oil positioned in an oil tank 160 which is formed as a corner portion of the fuel tank 130. This arrangement permits the fuel and oil tanks 130,160 to comprise a single integral member, reducing manufacturing and assembly costs.

Means are provided for delivering lubricant from the tank 160. Preferably, this means comprises an oil pump 162. As illustrated, the pump 162 is preferably positioned at an end of the crankshaft 48 at the front end of the engine 22 (i.e. at the end opposite the end of the crankshaft 48 which is coupled to the impeller shaft 62).

As is common in the two-cycle engine art, the oil pump 162 is arranged to deliver oil into the fuel for mixing therewith, whereby the fuel injectors 100 deliver a fuel and oil mixture. As illustrated, the oil pump 162 draws oil from the tank 160 through a supply line 164 and delivers it through an outlet 166 of a first delivery line 168 which extends to the fuel tank 130. Preferably, the outlet 166 of the line 168 is positioned near the inlet 138 of the fuel line 140.

In accordance with the present invention, the oil pump 162 is arranged to deliver oil directly into the engine 22 along the intake/exhaust path therethrough upstream of the water lock 124 of the exhaust system. In the preferred embodiment, the oil pump 162 delivers oil through a second delivery line 170 which terminates at an outlet 172 positioned in the throttle body 88 upstream (i.e. close to the silencer 86) of the throttle valve 90.

In this arrangement oil supplied into the throttle body 88 lubricates the throttle valve 90, preventing it from corroding and sticking and the like. In addition, the lubricant lubricates the fuel injectors 100.

The lubricant is also supplied to a point in the fuel tank 130 which is offset longitudinally (i.e. in a front-rear direction of the craft 20) from a center of gravity G of the watercraft. In this manner, the pitching movement of the watercraft 20 up and down about its center of gravity aids in the mixing of the oil with the fuel.

In this embodiment of the invention, the rate at which oil is delivered to the engine 22 through the fuel and directly to the engine, such as through the pipe 170 to the throttle body 88, may be different. Preferably, a larger quantity of oil is delivered directly through the pipe 170 is greater than that supplied with the fuel by the injectors 100. This may be accomplished with a flow restriction valve, pipe sizing or the like, as well known to those of skill in the art.

In accordance with this embodiment of the invention, the fuel pump 136 is positioned near the top of the fuel tank 130, and most importantly, a distance above the bottom surface 46 of the bottom portion 30 of the hull 26 by a distance which is greater than the distance that the outlets 81,83 of the intake pipes 82,80 are positioned above the bottom surface 46 of the hull 26. In order words, the fuel pump 136 is positioned higher than the outlets 81,83 of the intake pipes 82,80.

Also, the fuel pump 136 is positioned above the inlet 130 of the bilge pump 128.

In this arrangement, the fuel pump 136 is protected from water which may enter the engine compartment 42 through the intake pipes 80,82. In addition, the fuel pump 136 is well above the water line of water which may fill the engine compartment 42 before being pumped therefrom by the bilge pump 128.

Figure 4:
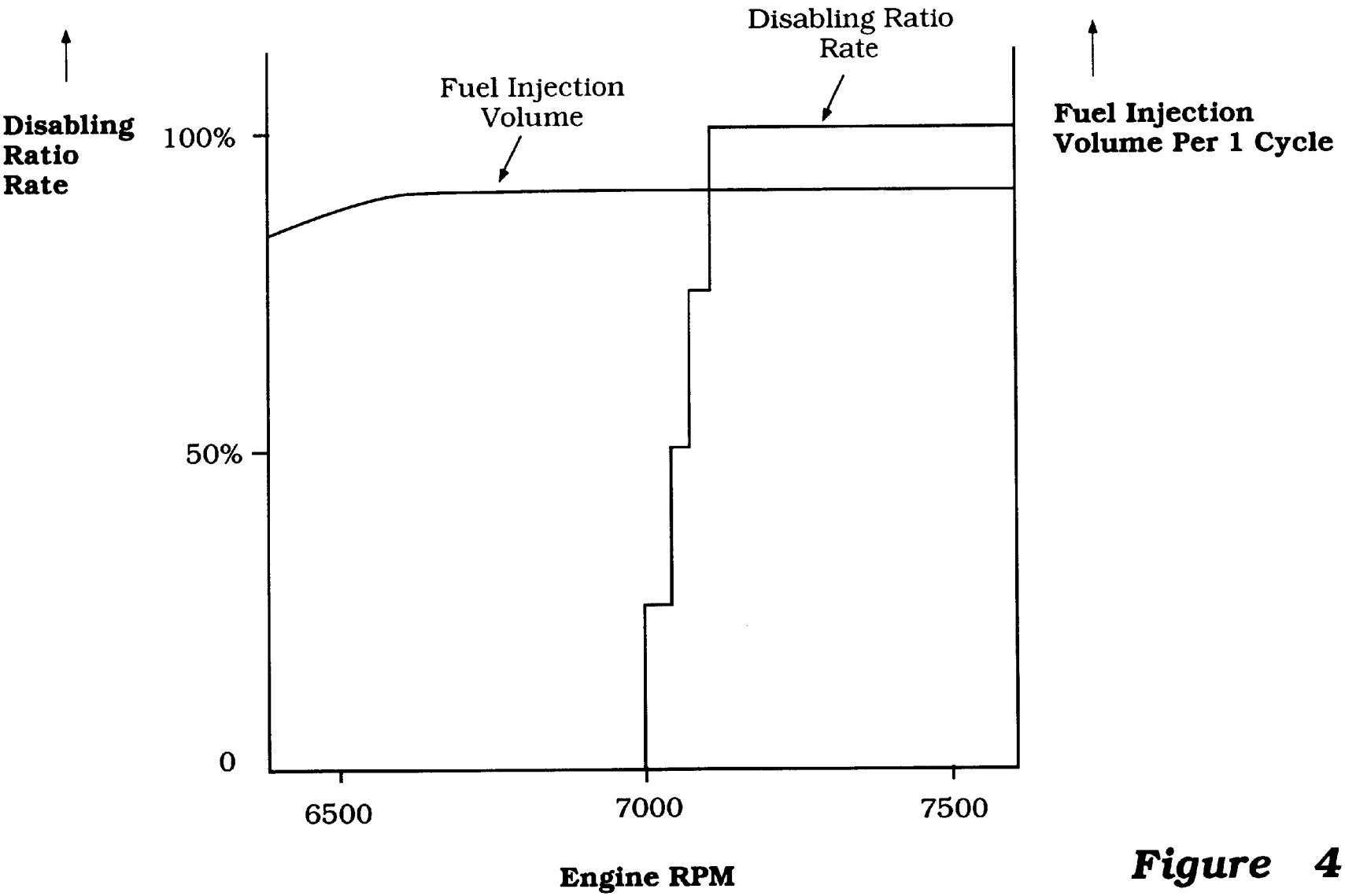
FIG. 4 is a graph illustrating a disabling ratio rate and fuel injection volume with respect to engine rpm in accordance with a first arrangement of the first embodiment of the present invention.

Preferably, the engine 22 includes an over-rev restriction or engine speed control. Preferably, this control is associated with the ECU 106. As illustrated in FIG. 4, and in accordance with a first arrangement of the invention, when the engine speed exceeds a predetermined high speed, such as 7000 revolutions per minute (RPM), the ignition element(s) 108 are selectively prevented from firing to slow the engine speed. Preferably, the rate at which the ignition elements 108 are disabled is increased in steps as the engine speed continues to rise above the predetermined speed until, at some very high speed, the ECU 106 is arranged to prevent the firing of the ignition elements 108 completely.

In accordance with this arrangement, however, the rate at which fuel is delivered to the engine 22 is maintained generally constant regardless of engine speed. In this manner oil which is supplied to the engine 22 with the fuel continues to be supplied to the engine 22 therewith.

Figure 5:
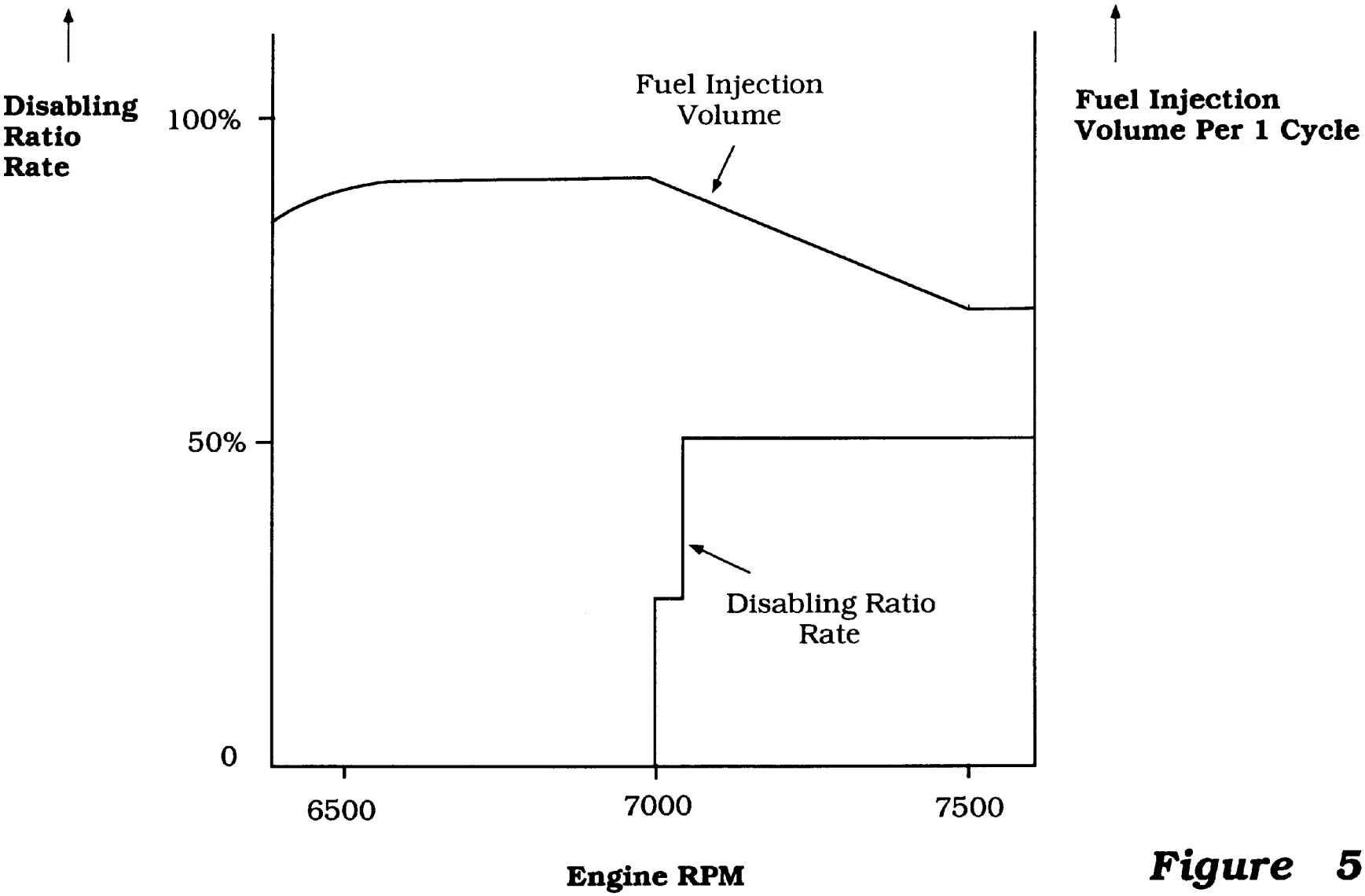
FIG. 5 is a graph illustrating a disabling ratio rate and fuel injection volume with respect to engine rpm in accordance with a second arrangement of the first embodiment of the present invention.

In accordance with a second arrangement over-rev control is illustrated in conjunction with FIG. 5. This arrangement is preferably used in conjunction with an engine having a catalyst positioned in the exhaust system thereof, whereas the first arrangement disclosed above is preferably used when no catalyst is present.

In this arrangement, it is generally desireable to limit the amount of fuel which is supplied to the engine 22 when the engine is not running to prevent unburned fuel and oil from entering the exhaust system and damaging the catalyst. As such, in this embodiment, the ECU 106 is arranged to selectively disable the ignition element(s) 108 when the engine speed exceeds a predetermined high speed, such as 7000 rpm. In this arrangement, the disabling is accomplished in steps, with an increasing rate of disabling used as the engine speed rises above the predetermined speed. Preferably, however, the maximum disabling rate is less than 100%, and most preferably 50%, whereby the engine 22 still continues to run for burning a substantial quantity of the fuel delivered thereto.

In addition, in this arrangement, the fuel injection volume is reduced, preferably the control signal from the ECU 106 to the injectors 100, once the engine speed exceeds the predetermined speed. In this manner, oil is still supplied with the fuel to the engine 22, but less unburned fuel is delivered to the exhaust system. In addition, in this arrangement, because the engine still runs, the oil pump 162 still delivers oil through the pipe 170 directly to the throttle body 88.

Figure 6:
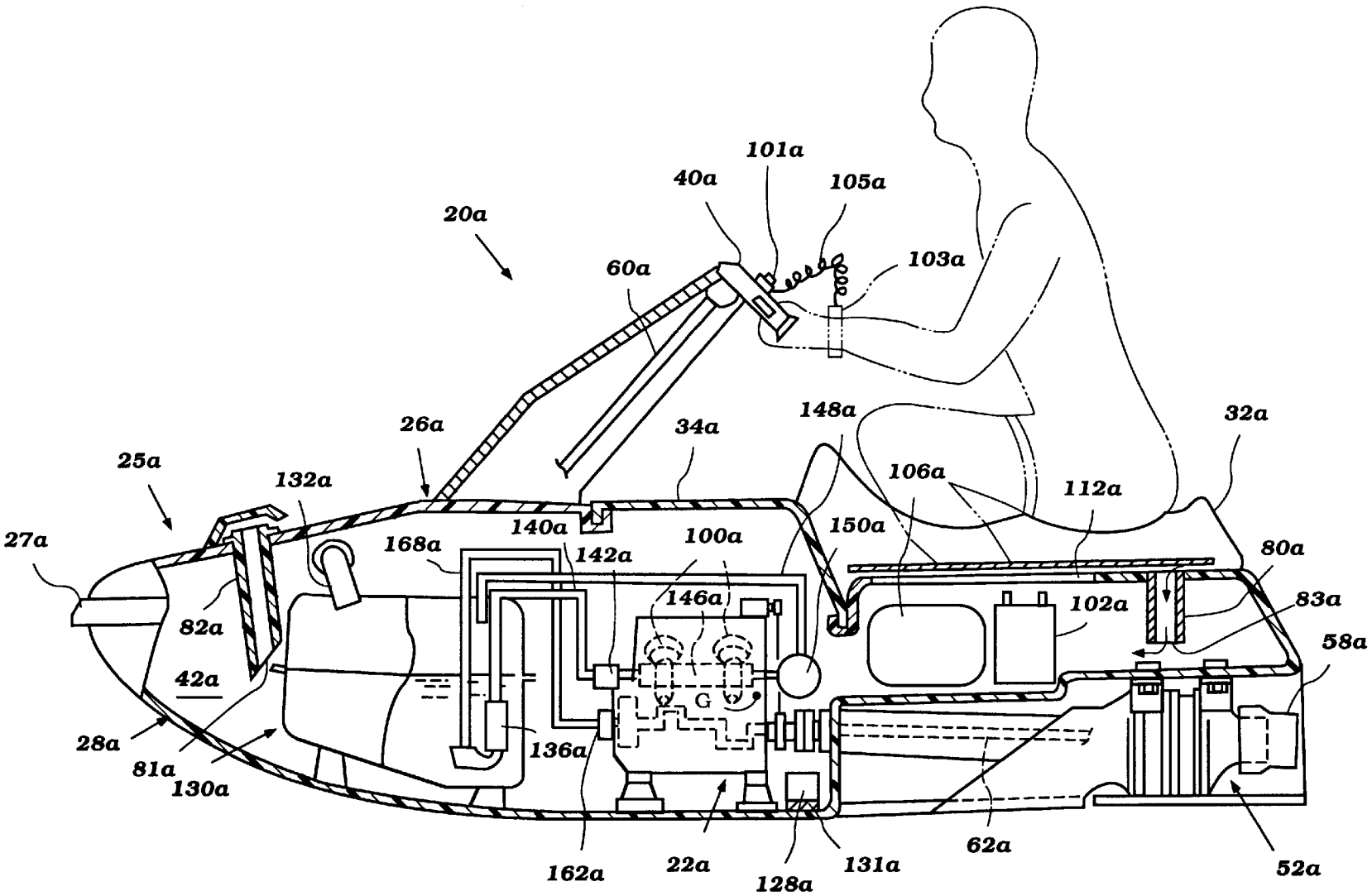
FIG. 6 is a cross-sectional side view of a watercraft powered by an engine and having an oil supply system in accordance with a second embodiment of the present invention.

A second embodiment of the present invention is illustrated in FIG. 6. This embodiment of the invention is similar in many respects to the first embodiment, and as such like or similar parts have been given like reference numerals to those used in the description and illustration of the first embodiment, except that an "a" designator has been added to all of the reference numerals of this second embodiment.

In this embodiment of the invention, the fuel pump 136*a* is preferably positioned in the fuel tank 130*a*. In this manner, the fuel pump 136*a* is protected from water which may enter the air intakes 80*a*,82*a*.

The oil supply system is again arranged to provide oil to the fuel for delivery therewith to the engine 22*a*. Preferably, oil is delivered by an oil pump 162*a* through a supply pipe 168*a* to the fuel tank 130*a*. The pipe 168*a* terminates within the tank 130*a* near an inlet of the fuel pump 136*a*. Again, the oil is introduced into the tank 130*a* at a position which is longitudinally offset from the center of gravity G of the watercraft 20*a*, so that the pitching movement of the watercraft 20*a* aids in the mixing of the oil with the fuel.

Though not illustrated, the fuel pump 136*a* may be positioned in a sealed box or in a vapor separator instead of the fuel tank 130*a*. In that arrangement, the sealed box or vapor separator in which the fuel pump 136*a* is positioned is preferably positioned higher than the inlet of the bilge, and more preferably positioned higher than the outlet of the intake ducts 80*a*,82*a*.

Figure 7:
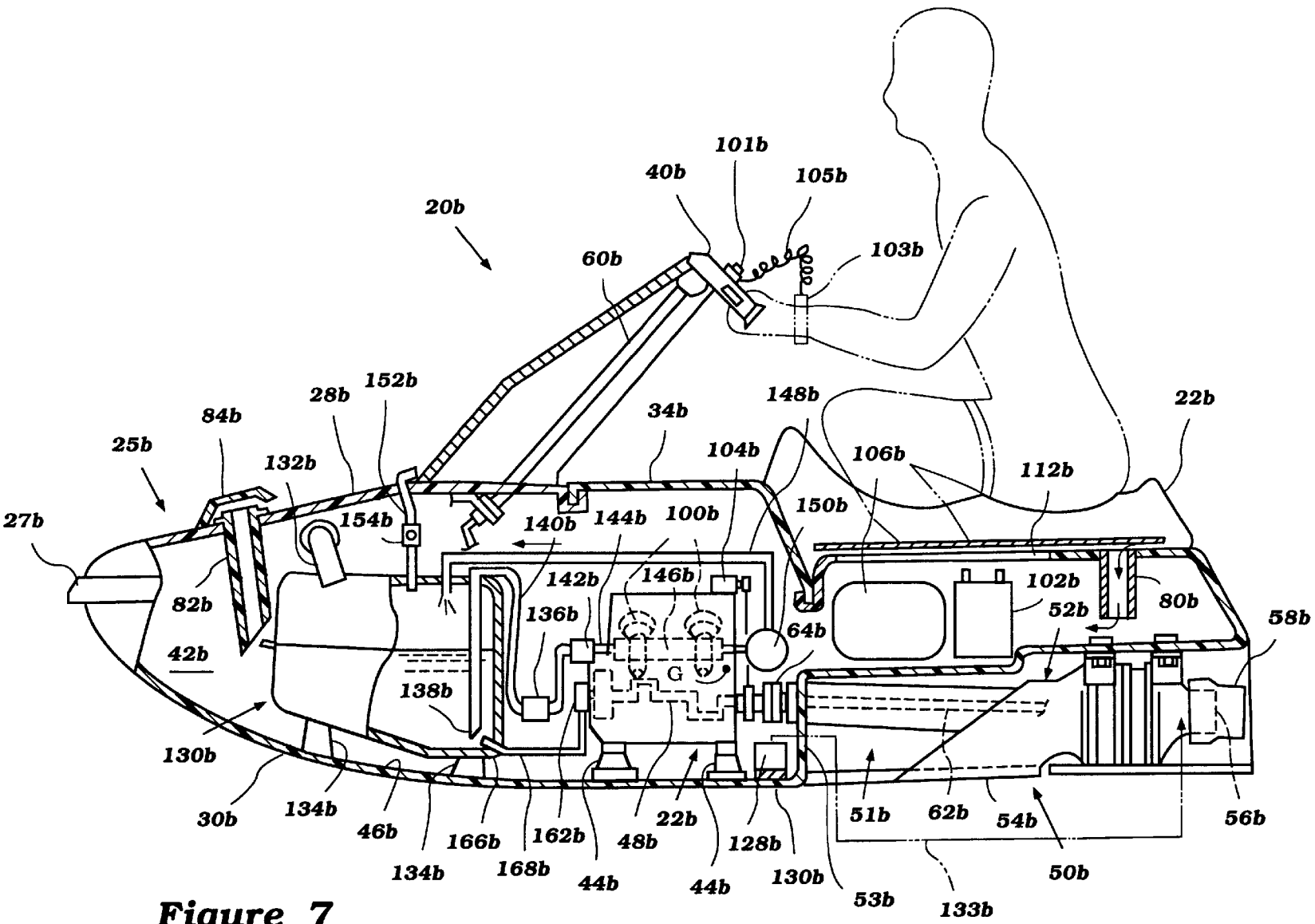
FIG. 7 is a cross-sectional side view of a watercraft powered by an engine and having an oil supply system in accordance with a third embodiment of the present invention.

A third embodiment of the present invention is illustrated in FIG. 7. This embodiment of the invention is similar in many respects to the first two embodiments, and as such like or similar parts have been given like reference numerals to those used in the description and illustration of the previous embodiments, except that a "b" designator has been added to all of the reference numerals of this third embodiment.

In this embodiment, the fuel pump 136*b* is positioned generally between the fuel tank 130*b* and engine 22*b*, although below the outlet of the air intake pipes 80*b*,82*b* but still above the inlet 130*b* of the bilge pump 128*b*. In this position, the fuel pump 136*b* is generally protected from water which may flow through the intake pipes 80*b*,82*b* because it is shielded by the fuel tank 130*b* and engine 22*b*.

Of course, the foregoing description is that of preferred embodiments of the invention, and various changes and modifications may be made without departing from the spirit and scope of the invention, as defined by the appended claims.

What is claimed is:

1. A watercraft having a hull defining an engine compartment and having a lower surface, said watercraft including a water propulsion device, an internal combustion engine positioned in said engine compartment and supported by said lower surface of said hull, said engine having an output shaft arranged to drive said water propulsion device, said watercraft having an air intake system for supplying said engine with air for use in a combustion process and for ventilating said engine compartment, said intake system including at least one air intake through said hull leading into and terminating at an air discharge point within said engine compartment, said watercraft including a fuel supply system for supplying fuel from a fuel supply to said engine for combustion, said fuel supply system including an electrically powered fuel pump for delivering fuel from said fuel supply to said engine, said fuel pump positioned within said engine compartment in a location avoiding exposure of said pump to water which enters said engine compartment through said hull by positioning said fuel pump in one of a location vertically above both the water level at which said hull assumes in the water and the air discharge point of said one air intake within said engine compartment and within the interior of said fuel supply below the fuel therein.

2. The watercraft in accordance with claim 1, wherein said fuel pump is positioned above said lower surface of said hull and higher than said discharge point of said air intake through said hull.

3. The watercraft in accordance with claim 1, wherein said air intake comprises an air intake pipe, said pipe having an outlet positioned within said engine compartment forming said air discharge point.

4. The watercraft in accordance with claim 3, wherein said hull has an upper part and said intake pipe extends downwardly therefrom into said engine compartment.

5. The watercraft in accordance with claim 1, wherein said watercraft includes a bilge pump having an inlet positioned near said bottom surface of said hull for pumping water from said engine compartment to a point external to said hull.

6. The watercraft in accordance with claim 5, wherein said fuel pump is positioned above said inlet of said bilge pump.

7. The watercraft in accordance with claim 1, wherein said fuel supply comprises a fuel tank and said fuel pump is positioned in said fuel tank.

8. The watercraft in accordance with claim 7, wherein said watercraft includes a bilge pump having an inlet positioned near said bottom surface of said hull for pumping water from said engine compartment to a point external to said hull and said fuel tank is positioned above said inlet of said bilge pump.

9. The watercraft in accordance with claim 7, wherein a top portion of said fuel tank is positioned above said lower surface of said hull higher than an outlet of said air intake through said hull.

10. The watercraft in accordance with claim 1, wherein said fuel supply comprises a fuel tank spaced from said engine and said fuel pump is positioned between said engine and fuel tank.

* * * * *